United States Patent [19]

Silverman et al.

[11] 4,411,419

[45] Oct. 25, 1983

[54] ARTICULATE BRIDGE ASSEMBLY

[75] Inventors: Harold Silverman, Norwalk; Alan B. Hotchkiss, Westport, both of Conn.

[73] Assignee: Pitney Bowes Inc., Stamford, Conn.

[21] Appl. No.: 185,855

[22] Filed: Sep. 11, 1980

[51] Int. Cl.[3] ..... B65H 7/12; B65H 5/02

[52] U.S. Cl. ..... 271/263; 49/386; 271/274; 271/275; 312/319; 312/328

[58] Field of Search ..... 271/262, 273, 274, 275, 271/263, 264, 200; 53/266 A; 312/269, 319, 328; 49/386; 355/76, 75

[56] References Cited

U.S. PATENT DOCUMENTS

| | | | |
|---|---|---|---|
| 2,914,895 | 12/1959 | Martin | 53/117 X |
| 3,330,612 | 7/1967 | Masterson et al. | 312/319 |
| 3,411,771 | 11/1968 | Bahr et al. | 271/273 |
| 3,615,134 | 10/1971 | Newcomb | 49/386 X |
| 3,661,383 | 5/1972 | Morrison | 271/273 |

FOREIGN PATENT DOCUMENTS

| | | | |
|---|---|---|---|
| 616211 | 1/1949 | United Kingdom | 49/386 |

*Primary Examiner*—Bruce H. Stoner, Jr.
*Attorney, Agent, or Firm*—D. P. Walker; M. J. Scolnick; A. W. Scribner

[57] ABSTRACT

An articulate bridge assembly covers an enclosure transport pathway from an enclosure feeder through an enclosure pick-up station in a reciprocating ram type envelope inserter. The bridge includes a cover hinged along an axis parallel to the transport pathway. The horizontal and vertical planes of the cover are stabilized with reference to the inserter frame by spring mechanisms incorporated in the cover hinge assembly. A switch for detecting multiple enclosures in the pathway is mounted to the cover. To adjust the switch for various enclosure thicknesses, a knob at the face of the inserter is rotated. The knob advances a lead screw against a sloped surface of a pivot link. The pivot link in turn bears against a bracket assembly carrying the switch. The upper surface of the cover is planar and obstruction free, while a chassis is carried by the undersurface. Mounted to the chassis are skis which urge successive enclosures against transport belts. An enclosure position sensing switch and an enclosure stop gate are provided. The stop gate includes an upper door which is mounted to the chassis through a pivotal offset link. The gate simultaneously retracts from an operative position beneath an envelope flapper and automatically pivots when the bridge is opened.

8 Claims, 18 Drawing Figures

180
178
184
180
170
174
176
172
186
185
174
175
200
181
183
182
190
192
188
187
190
192
50
202
204
48
198
196
206
208
212
210
218

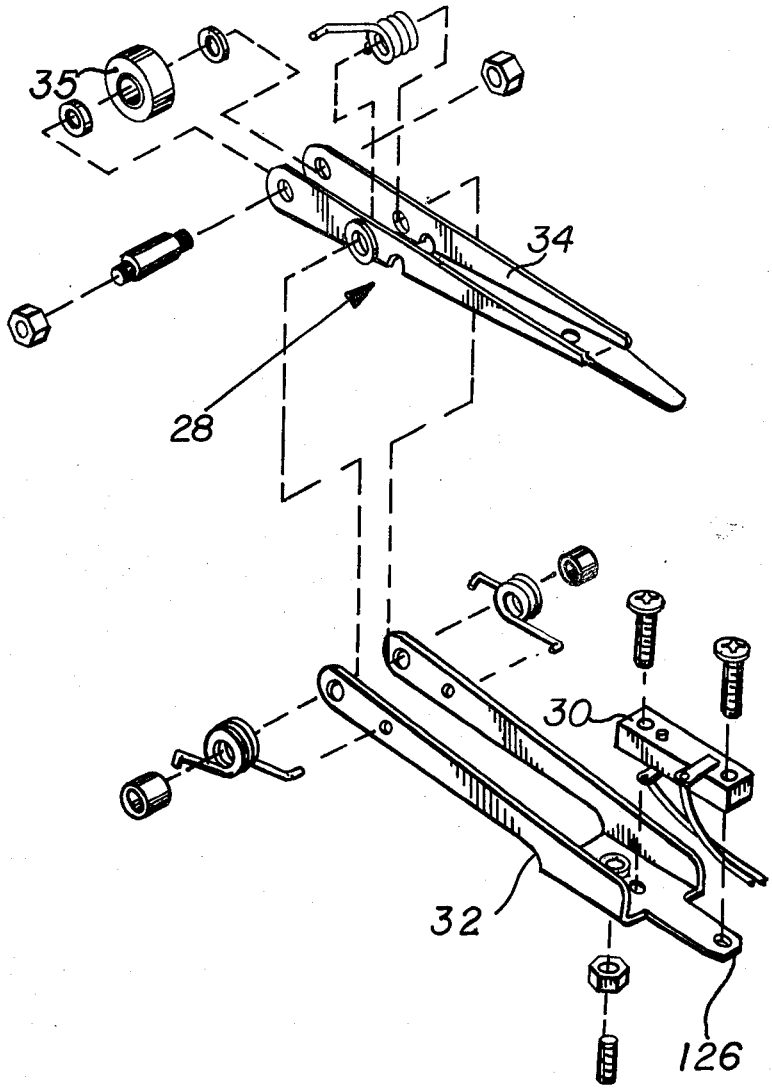
FIG. 9
FIG. 15
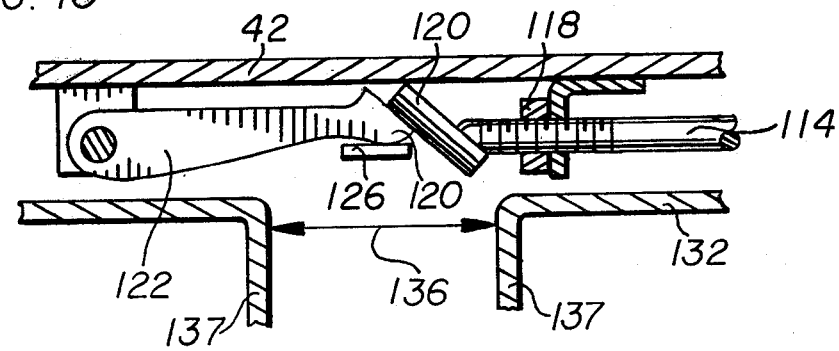

ENVELOPE FLAPPER 62
248
244
232
230
234
218
236
238
240
242
246
42
218
132
224
228
220
226
50
190
192
193
180
182
174
15
56
144
202
200
50
196
132
214
189
210
42
218
132
143
142
228
220
224

ARTICULATE BRIDGE ASSEMBLY

BACKGROUND OF THE INVENTION

1. Field of the Invention

The present invention relates generally to envelope inserters and more particularly to an improved bridge assembly for a reciprocating ram type envelope inserter.

2. Brief Description of the Prior Art

Inserters have played a significant role among the labor saving devices available to businesses which were engaged in the daily mailing of large numbers of pieces. Among the advantages of inserter usage has been the reduction in personnel required to produce large quantities of outgoing mail. Further, mail room personnel have been relieved of the monotonous task of individually stuffing a seemingly insurmountable number of envelopes. Inserters have been particularly well adapted for use in the mailing of form letters and the like and have been employed for the insertion of personalized documents, e.g. computer generated letters, checks, tab cards, etc., into window envelopes.

In U.S. Pat. No. 2,914,895 issued Dec. 1, 1959 to Samuel W. Martin, and assigned to the assignee of the present invention, an envelope inserter having a reciprocating ram blade with an enclosure pusher secured to the blade undersurface was described. The ram blade was mounted for reciprocal movement along a horizontal plane from a home position, in front of an enclosure pick-up station, to an envelope station. The pusher engaged the enclosure beneath the ram blade and drive it into the envelope.

Such operating mode was typical among the Pitney Bowes Series 3300 inserters. Enclosures were fed from an enclosure feeder to the pick-up station by a pair of transport belts. Skis mounted to the underside of a cover or bridge plate in registry with transport belts urged each enclosure into driving engagement with its respective belt. The bridge or cover plate carried an enclosure pick-up station gate adjacent its forward end.

In the Pitney Bowes Model 3320 Insertermate inserter, the enclosure gate was positioned beneath, i.e. tucked under, an envelope flapper which was part of an envelope feeding assembly. Additionally, a rigid bridge bracket was secured to the inserter frame and overlied the bridge plate. The bridge bracket provided a rigid mount for a double detector switch. Adjustment of the switch was possible only when the operator leaned over the top of the machine and grasped an adjustment knob which projected from the top of the bracket. Because the adjustment knob and other projections extended from the top of the bracket, the bracket did not present an obstruction free flat surface for tamping enclosures into orderly stacks prior to loading and a table or other work surface was often necessary.

In addition, the bracket was not user removable in the event one or more enclosures become jammed along the pathway beneath the bridge. In the event an enclosure jam occured at the pick-up station, the enclosure gate was movable to access the pick-up station, however it was first necessary to move the envelope flapper. Difficulties encountered in removing jams in the transport pathway and at the pick-up station often rendered an inserter inoperative and a service call was required. Furthermore, accessing the pick-up station or the ram mechanism for adjustments required the envelope flapper to be rotated to a non-operative position clear of the enclosure gate door. Additionally, mail room personnel often neglected to restore the envelope flapper to operative position which resulted in the seemingly inexplicable failure of the inserter to operate.

SUMMARY OF THE INVENTION

The invention comprises a bridge assembly which covers an enclosure transport pathway of an inserter. The bridge assembly is pivotally mounted to the inserter frame through a hinge which includes springs which bias a hinge pin to establish a horizontal reference plane for the bridge. The hinge includes a radial end cam fixed to the pin and a further radial end cam within which the pin is journalled. The further cam is spring biased against the fixed cam. Such spring bias establishes a vertical reference plane for the bridge. When the bridge is opened, the cam lobes interfit one another and the biasing spring becomes distended.

The bridge includes a cover having an upper surface which is flat and obstruction free. The cover may be employed by an operator for tamping enclosures into orderly stacks prior to loading the enclosure stacks.

A switch for detecting the thickness of enclosures along the pathway and thus indicating a misfeed of multiple enclosures is secured to a bracket assembly which is, in turn, pivotally mounted to the bridge cover. The switch is adjusted by rotating an access knob in the front wall of the bridge cover to advance a lead screw against a sloped surface of a pivot link which causes the switch bracket assembly to pivot relative to the bridge cover.

A chassis is secured to the cover and carries an enclosure pick-up station stop gate which is mounted through a pivotal offset link. When the cover is opened, the gate retracts from an operative position beneath an envelope flapper, while it pivots about the link. The cover additionally carries a pair of spring biased depending skis which urge enclosures against transport belts of the inserter and an enclosure position sensing switch.

From the foregoing compendium, it will be appreciated that it is an object of the present invention to provide an inserter bridge assembly of the general character described which is not subject to the disadvantages of the prior art as aforementioned.

A further object of the present invention is to provide an inserter bridge assembly of the general character described which covers an enclosure transport pathway and furnishes a planar obstruction free work surface for operator use.

Another object of the present invention is to provide an inserter bridge assembly of the general character described which is pivotally mounted to an inserter and assures a return to vertical and horizontal reference planes when replaced in operative position.

Another object of the present invention is to provide an inserter bridge assembly of the general character described which facilitates operator access for adjustment and routine maintenance.

A further object of the present invention is to provide an inserter bridge assembly of the general character described which facilitates simple adjustment of a switch for detecting multiple enclosures in a transport pathway.

A still further object of the present invention is to provide an inserter bridge assembly of the general character described which includes an enclosure stop gate for a ram pick up station operatively positioned beneath a portion of an envelope flapper wherein the pick up station may be accessed without requiring the flapper to be moved from an operative position.

Other objects of the invention in part will be obvious and in part will be pointed out hereinafter.

With these ends in view, the invention finds embodiment in various combinations of elements and arrangements of parts by which the said objects and certain other objects are attained, all as fully described with reference to the accompanying drawings and the scope of which is more particularly pointed out and indicated in the appended claims.

BRIEF DESCRIPTION OF THE DRAWINGS

In the accompanying drawings in which is shown one of the various possible exemplary embodiments of the invention;

FIG. 9 is an exploded perspective illustration of a switch assembly for detecting multiple enclosures, the same also being illustrated in an inverted position;

FIG. 15 is an enlarged fragmentary sectional view through a portion of the cover and the chassis, with portions of the switch assembly shown in FIG. 9 deleted for clarity and showing a mechanism for adjusting the switch assembly;

DESCRIPTION OF THE PREFERRED EMBODIMENT

Figure 1:
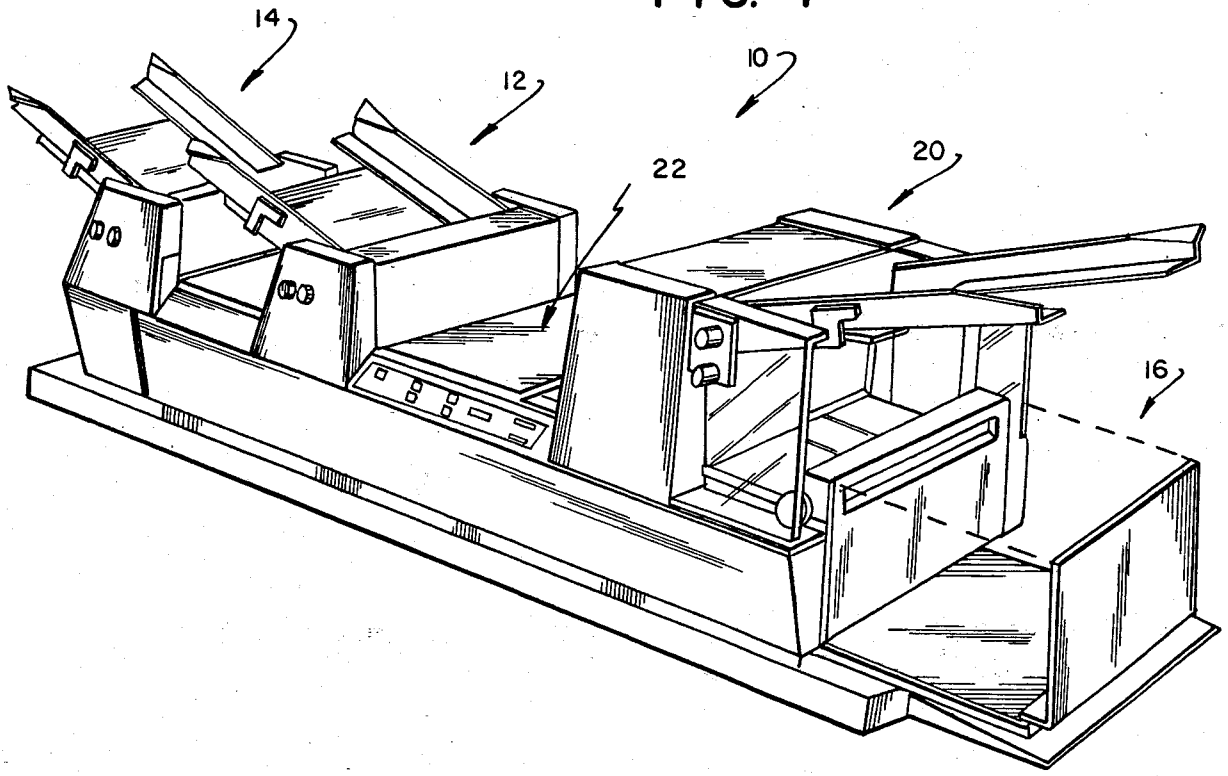
FIG. 1 is a perspective illustration of a typical inserter including an articulate bridge assembly constructed in accordance with the present invention and illustrating a pair of enclosure feeders which deliver successive enclosures to a transport pathway for deposit at a pick-up station and an envelope feeder which delivers envelopes for deposit at an envelope station and with the bridge assembly covering the pathway.

Referring now in detail to the drawings, the reference numeral 10 denotes generally an inserter constructed in accordance with and embodying the invention. The inserter 10 is similar in construction and operation to the Pitney Bowes Model 3320 Insertamate inserter and includes a first station enclosure feeder 12 and a second station enclosure feeder 14. The inserter 10 includes a reciprocating ram which automatically stuffs enclosures from the first feeder 12, the second feeder 14 or both sequentially into an envelope and delivers each stuffed envelope into a stack or tray 16. An operator loads envelopes directly from an envelope carton into a tray of an envelope feeder 20. The envelope feeder 20 includes an envelope flapper which opens the envelope flaps prior to delivery of envelopes to an envelope station for insertion of the enclosure.

In operation, enclosures and envelopes are individually removed from their stacks by the respective feeders 12, 14. Enclosures are transported from the second station enclosure feeder 14 to the first station enclosure feeder 12 along a deck by transport belts. Enclosures, fed from the first station enclosure feeder 12 or transported from the second station enclosure feeder 14 to the first station enclosure feeder 12, are transported through a transport pathway which extends from the first station enclosure feeder 12 through and including a ram pick-up station 15. At the ram pick-up station, enclosures are stuffed by the reciprocating ram into envelopes seated at the envelope station.

The transport pathway is covered by an articulate bridge assembly 22 constructed in accordance with an embodying the present invention. The articulate bridge assembly 22 is hingedly mounted to the rear of the inserter frame and is pivoted to an open position to access the transport pathway for the purpose of clearing jams and rendering operator adjustments. In addition, a multiple enclosure detection switch assembly is carried by the bridge 22 and is adjusted through a knob on a front panel of the bridge.

Figure 3:
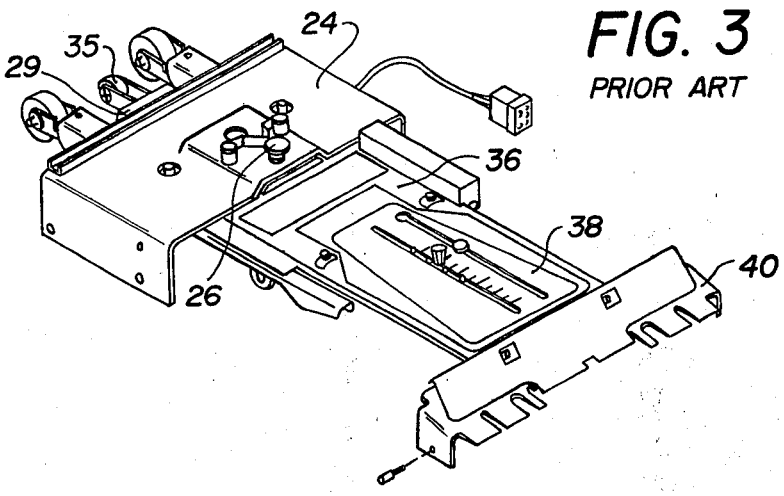
FIG. 3 PRIOR ART
FIG. 3 is a reduced scale perspective illustration of a prior art bridge assembly.
Figure 4:
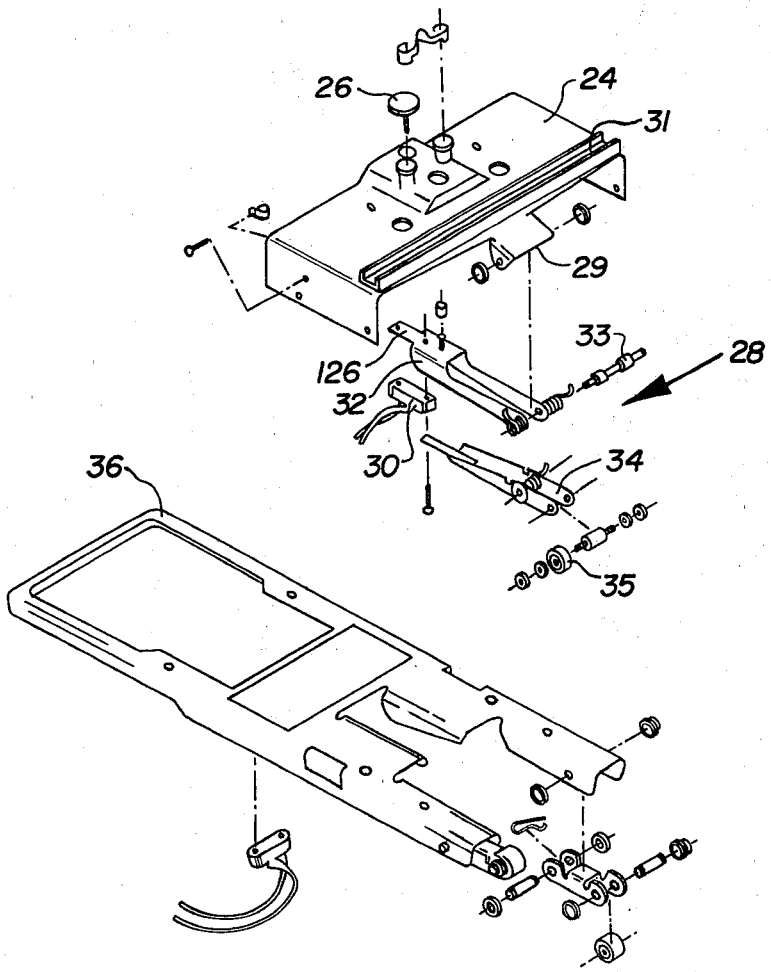
FIG. 4 PRIOR ART
FIG. 4 is an exploded perspective illustration of the prior art bridge assembly depicted in FIG. 3 rotated 180°, however.

The bridge assembly employed in the prior Pitney Bowes Model 3320 Insertamate inserter is illustrated in FIGS. 3 and 4. Such bridge included a rigid bridge bracket 24 which was secured to the inserter frame. The bridge bracket 24 carried a thumb screw 26 for adjusting a multiple enclosure switch assembly 28. The switch assembly 28 included an electrical switch 30 mounted between a pair of arms of an upper bracket 32. A lower bracket 34 included a finger at one end which was engageable to actuate the switch 30. At the opposite end, the lower bracket 34 included a contact roller 35 which engaged enclosures along the transport pathway. Both brackets 32, 34 were mounted to a bridge bracket 24 through a pin 33. The pin 33 spanned between parallel walls 29 of a mount which included a reinforcement U channel 31. The channel 31 was secured to the top of the bridge bracket 24. Adjustment of the thumb screw 26 resulted in pivotal movement of the entire switch assembly 28 about its pivotal mounting to the bridge bracket 24.

The prior bridge assembly additionally included a bridge chassis 36 which extended along the transport pathway. An enclosure stop gate having a door 38 was mounted to the chassis 36 in registry with the pick-up station. Additionally included was an envelope ledge 40.

In accordance with the present invention, the articulate bridge assembly 22 includes a generally planar obstruction free cover 42 which is horizontally oriented when in an operative position and includes a front panel 44. A bridge chassis 46 is mounted to the underside of the cover 42 and extends longitudinally along and above the transport pathway. At the end of the pathway which approaches the envelope station, the chassis includes an enclosure gate 48 having an upper door 50.

Figure 6:
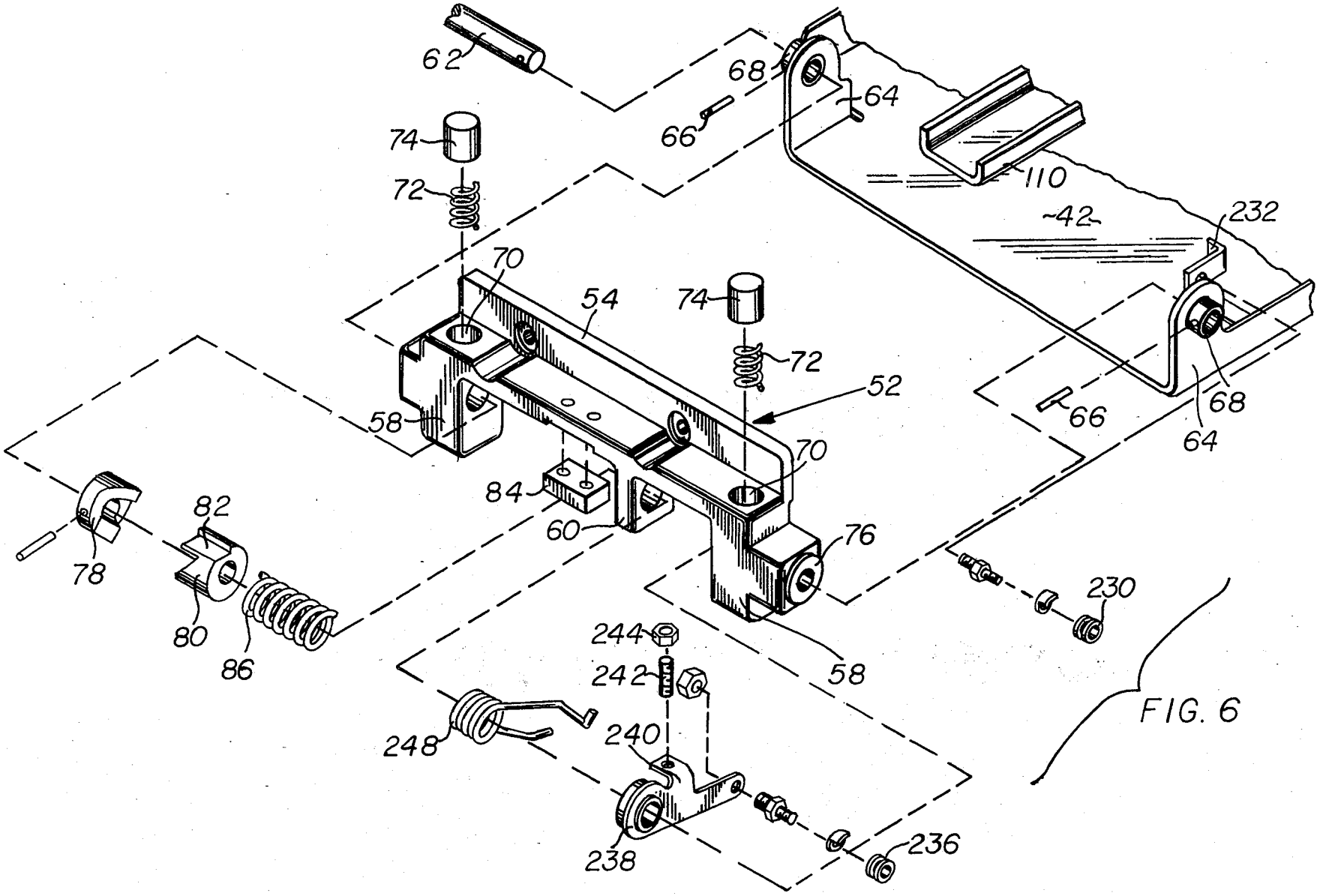
FIG. 6 is an exploded perspective illustration of a hinge assembly which interconnects the bridge cover and the inserter frame and showing a portion of the bridge cover, with the components shown inverted and some components omitted.
Figure 12:
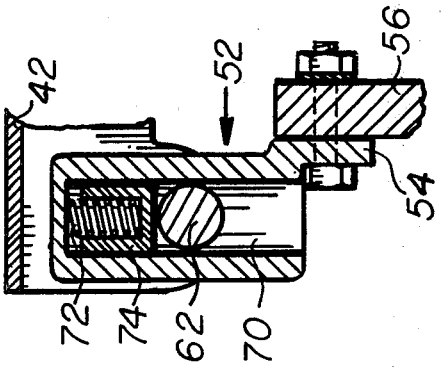
FIG. 12 is a sectional view through the hinge and the inserter frame, the same being taken substantially along the line 12—12 of FIG. 11.
Figure 11:
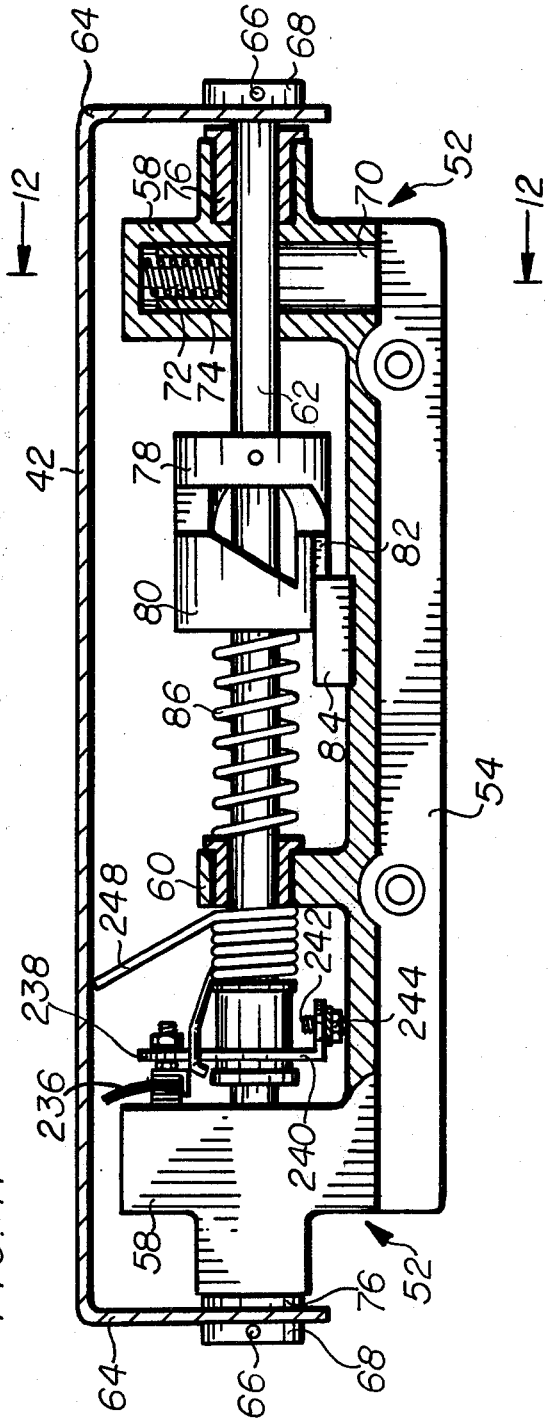
FIG. 11 is an enlarged scale sectional view through the bridge cover and a hinge which interconnects the bridge assembly to the inserter frame, the same being taken substantially along the plane 11—11 of FIG. 2.
Figure 13:
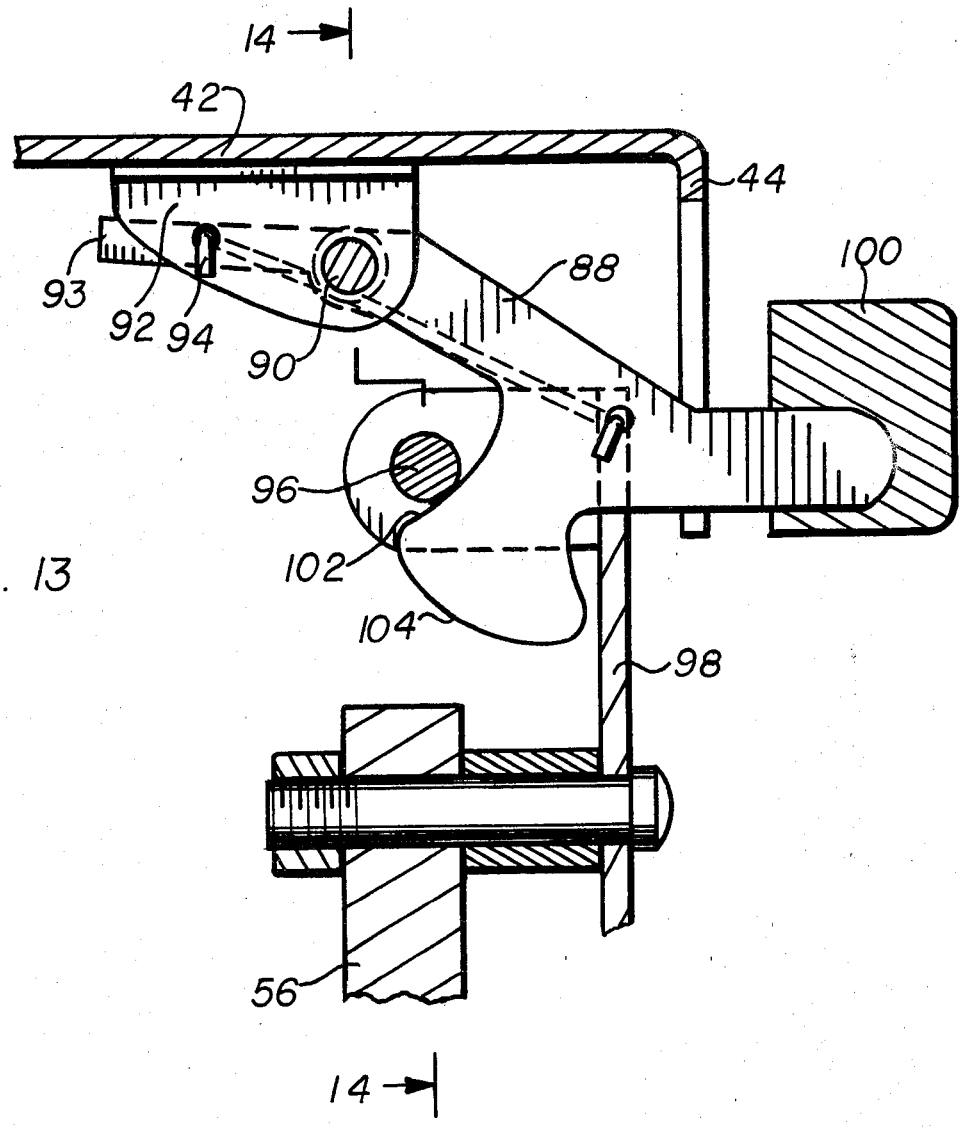
FIG. 13 is an enlarged fragmentary sectional view through the cover and a portion of the frame and showing a cover latch mechanism.

In lieu of being rigidly bolted to the inserter frame as was the bridge bracket 24, the cover 42 is hinged. Referring now to FIGS. 6, 11 and 12, a hinge mechanism which serves to pivotally mount the bridge assembly 22 to the inserter 10 is shown. The hinge mechanism includes a hinge casting 52 having a lower flange 54. The flange 54 includes a plurality of apertures for bolting the casting 52 to the rear frame 56 of the inserter 10 (FIG. 12). A pair of end bosses 58 project upwardly from the hinge casting 52 adjacent the ends thereof and an interior boss 60 similarly projects upwardly between the end bosses. The bosses 58, 60 include a bore along a common longitudinal axis for receiving a hinge pin 62. A pair of cover hinge brackets 64 include apertures for receiving the hinge pin 62 with the cover 42 being fixed with respect to the hinge pin 62 by a set pin 66. The set pin 66 extends transversely through the hinge pin 62 and registered apertures which extend through hubs 68 projecting from the brackets 64 of the cover 42.

In order to assure that the cover 42 always returns to the same horizontal reference plane after being pivoted to its open position, the end bosses 58 include a pair of vertical bores 70 which extend perpendicular to and intersect the hinge pin bores. A helical coil spring 72 and a cylindrical force cup 74 are inserted through each bore 70 and compressed to allow the hinge pin 62 to extend through its bore.

It should be appreciated that the springs 72 and force cups 74 bias the hinge pin 62, hence the bridge 22, in a downward direction relative to the hinge casting 52 and thus establish a horizontal reference plane to which the cover 42 returns when in its operative position. The downward bias against the hinge pin 62 causes the pin to bear vertically against an end bearing 76 seated in an enlarged portion of the bore which extends through the bosses 68. The bearings 76 include an enlarged thrust collar which occupies the space between the inner surface of each cover bracket 64 and the bosses 58 of the hinge casting.

A radial end cam 78 is mounted concentrically with and is fixed to the hinge pin 62 by a set pin which extends transversely through both the cam 78 and the hinge pin 62. The hinge pin 62 is journalled for rotation within a mating radial end cam 80. The cam 80 includes a keyway 82 which engages a stop block 84 to prevent rotation of the cam 80.

To maintain the bridge cover 42 stable with respect to a vertical reference plane, a helical coil compression spring 86 is positioned concentrically about the hinge pin 62 between the slidable cam 80 and the boss 60. The spring 86 urges the cam 80 against the cam 78 which is fixed to the hinge pin. Thus, the hinge pin 62 and the bridge cover 42 fixed thereto are biased toward the right as viewed in FIG. 11. As a consequence, the juncture of the inner face of the left bracket 64 and the thrust collar of the bearing 76 constitute a vertical reference plane for the bridge assembly 22.

Pursuant to the present invention, the radial end cams 78, 80 are additionally employed for the purpose of providing a counterbalancing force when the bridge assembly 22 is pivoted to an open position. The cam 80 is free to slide along the axis of the hinge pin 62 toward and away from the cam 78. Rotation of the cam 80 is prevented, however, by engagement of the stop block 84 in the keyway 82. During the opening rotation of the cover 42, the opposed camming surfaces intermesh with one another and the cam 80 slides toward the cam 78 with the compression spring 86 expanding. The relationship of the camming surfaces is such that the lateral force applied by the spring 86 through the cam 80 tends to rotate the hinge pin 62, hence the cover 42, into its open position.

Conversely, on closing the cover 42, rotation of the cam 78 causes the camming surfaces to disengage one another forcing the cam 80 away from the cam 78 and compressing the spring 86. The spring 86 and the cams 80, 78 thus serve as a counterbalance against the weight of the bridge assembly 22 during the opening and closing of the bridge assembly and additionally serve to maintain the bridge assembly in its open position.

The cover is maintained in its operative (horizontal) position by a latch mechanism. Referring now to FIGS. 2, 5, 13 and 14 wherein various details of the latch mechanism are disclosed, a camming latch 88 is journalled for rotation about a pin 90 which is mounted to a channel bracket 92. The bracket 92 is secured to the undersurface of the cover 42 adjacent the front panel 44 with the latch 88 extending through a slot in the front panel. A torsion spring 94 applies a clockwise (as viewed in FIG. 13) torque to the latch 88. The latch engages a bolt 96 which is fixed to a rigid bracket 98 in turn mounted to and spaced from the front of the inserter frame 56. To open the latch 88, an operator grasps a knob 100 accessible at the front panel 44 and pivots the latch 88 upwardly.

The latch 88 includes two camming surfaces. An upper camming surface 102 engages the underside of the latch bolt 96 to secure the cover 42 in its closed position. When the bridge assembly 22 is open, the latch 88 assumes a position substantially the same as that shown in FIG. 13. This position is assumed due to the bias of the spring 84 and engagement of a tail 93 of the latch against the bracket 92.

When the cover 42 is pivoted downwardly, a sloped lower camming surface 104 engages the upper surface of the bolt 96. Such engagement causes the latch 88 to pivot in a counterclockwise direction (as viewed in FIG. 13) until such time as the bolt 96 is received on the upper camming surface 102 whereupon the spring 94 causes the latch to seat itself in locking engagement under the bolt.

The integrity of the horizontal plane of the cover 42 is maintained at the front of the cover 42 by a pair of adjustable threaded posts 106 which are received through appropriate collars and mounted to an inwardly projecting flange of the bracket 98. The bracket 98 is, of course, rigidly secured to the frame 56.

The maintenance of the integrity of the vertical and horizontal planes of the bridge assembly 22 is of importance not only for the purpose of assuring alignment of various components and thus reducing the possibility of jams occurring in the transport pathway but, in addition, for the purpose of assuring that a multiple enclosure switch assembly will not be required to be reset each time the bridge assembly 22 is opened. The bridge assembly 22 includes a multiple enclosure switch assembly 28 quite similar to the switch assembly 28 previously described with reference to the Pitney Bowes Model 3320 Insertamate inserter.

Figure 5:
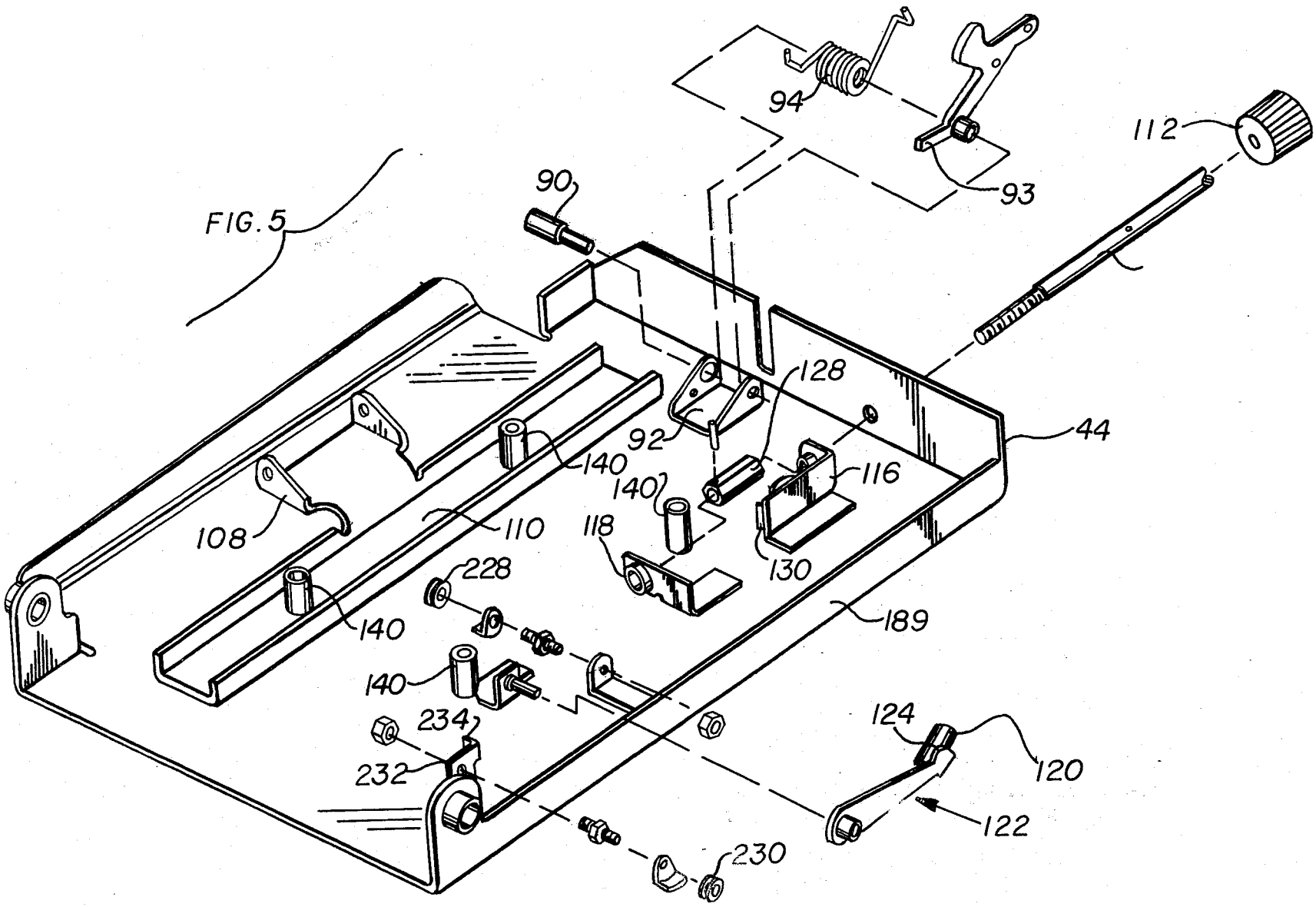
FIG. 5 is an exploded perspective view of the bridge cover, in an inverted position, with portions deleted for clarity.

Referring now to FIG. 9 and bearing in mind that the exploded views in FIGS. 6 through 9 show the components in inverted position, the switch assembly 28 includes an electrical switch 30 which is secured to an upper bracket 32. A lower bracket 34 includes a finger which is engageable to actuate the switch 30. In lieu of mounting the switch assembly 28 to a rigid bridge bracket as shown in FIGS. 3 and 4, the switch assembly 28 is pivotally mounted to a hinge bracket 108 which projects from a U-shaped reinforcing channel 110 secured to the underside of the cover 42 as shown in FIG. 5.

Furthermore, in accordance with the present invention, an adjustment knob 112 accessible from the front panel 44 engages a lead screw shaft 114 for switch adjustment. The shaft 114 extends through an aperture in the front panel 44 and is journalled through an aperture in a first support bracket 116. The forward end of the shaft 114 is in engagement with a threaded collar 118 fixed to a second bracket.

As shown in FIG. 15, when the shaft 114 is rotated, its forward tip engages a sloped surface 120 of a pivot link 122 and a lower bearing surface 124 of the pivot link engages a leg 126 of the upper bracket 32 for switch adjustment. In the prior model 3320 inserter, the thumb screw engaged the leg 126 for switch adjustment.

Returning to FIG. 5, it will be observed that in order to provide detent stops, the shaft 114 extends through a hexagonal collar 128 positioned between the first bracket 116 and the threaded collar 118. The hexagonal collar 128 is pinned to the shaft 114. A leaf spring 130 is mounted to the bracket 116 and bears against the flat surfaces of the collar 128 to provide the detent stops.

Figure 7:
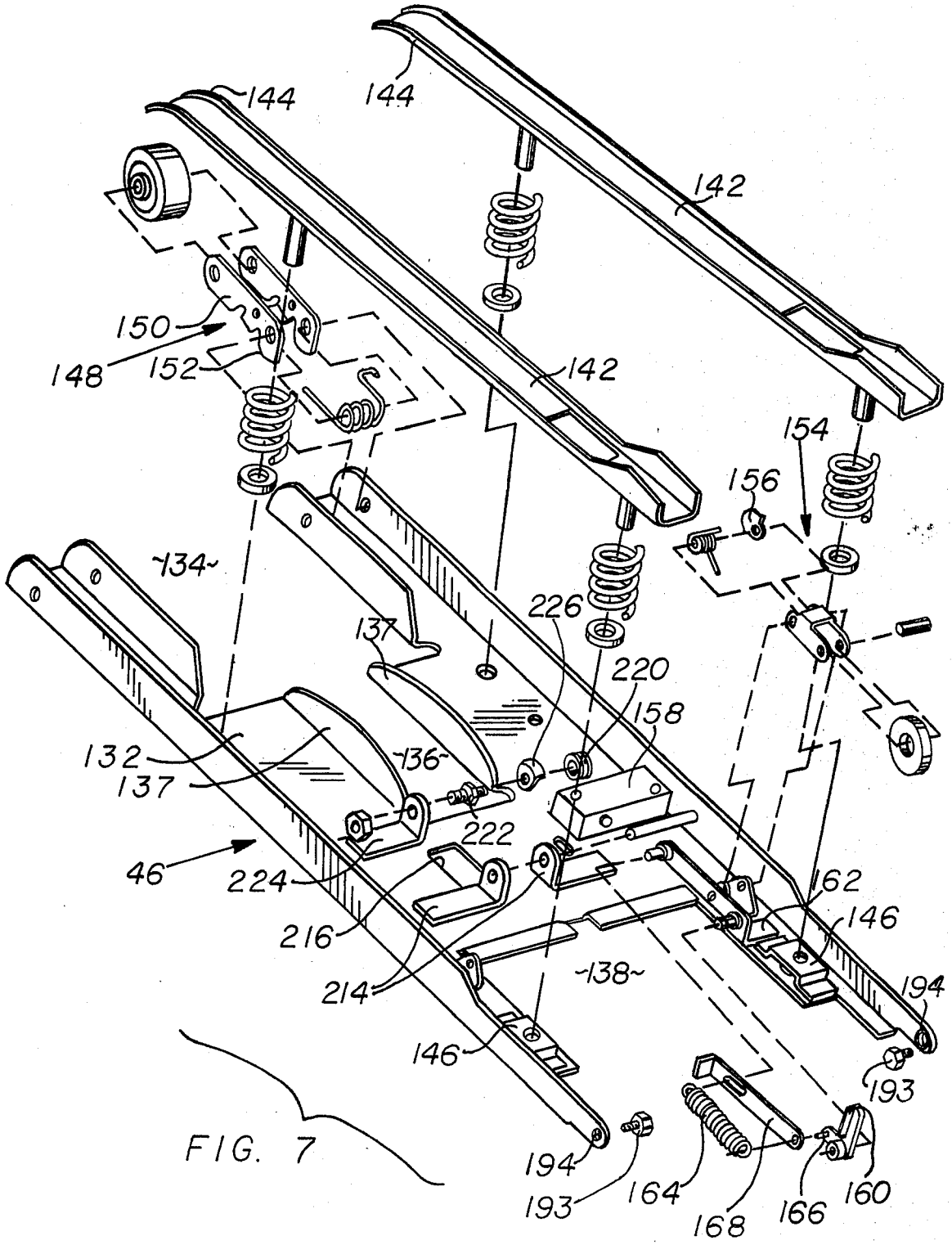
FIG. 7 is an exploded perspective view of the bridge chassis, also in an inverted position and with portions deleted.

Referring now to FIG. 7 wherein the chassis 46 is shown in an inverted position, it will be seen that the chassis 46 generally comprises a planar panel 132 having an enlarged aperture 134 at its forward end which extends into an intermediate aperture 136. A further aperture 138 is provided at the trailing end for the purpose of mounting the enclosure pick-up station gate 48.

It should be noted that the panel 132 includes downturned side walls 137 having curved edges at the intermediate aperture 136. The curved side wall edges provide guides for enclosures in the transport pathway. In the assembled bridge, the switch hinge bracket 108 extends downwardly into the area of the enlarged forward aperture with the switch 30 and the switch brackets 32, 34 extending into the intermediate aperture between the side walls 137.

The chassis 46 is secured to the undersurface of the cover 42 by conventional screws which extend through apertures in the panel 132 and engage threaded collars 140 which project downwardly from the undersurface of the cover (see FIG. 5). As previously mentioned, the bridge assembly 22 includes a pair of skis 142 which engage the upper surface of enclosures along the transport pathway and urge such enclosures against transport belts 143. Accordingly, the skis 142 are upwardly curved at their forward ends 144 and project downwardly at their trailing ends for the purpose of guiding enclosures into a lower elevation ram pick-up station 15 (see FIG. 18).

The structure of the skis 142 is substantially the same as that of the skis employed in U.S. Pat. No. 2,914,895 incorporated herein by reference. Accordingly, the skis include a pair of upwardly projecting studs over which helical compression springs are positioned. The springs serve to downwardly bias the skis from the undersurface of the chassis 46. It should be noted that the studs at the trailing end of the skis are of shorter length than those at the forward end. This is for the purpose of accommodating the springs and studs between the skis and a mounting bracket 146 in lieu of having the studs project through the upper surface of the chassis panel 132.

A pair of pick-up roller assemblies 148 are pivotally mounted at the forward end of the chassis. The pick-up roller assemblies 148 are substantially identical to the pick-up roller assemblies illustrated in FIGS. 3 and 4 and includes a torsion spring which downwardly biases a pick-up roller. A mounting bracket 150 which interconnects each pick-up roller with the chassis 46 is of modified construction, however, and includes an abutment 152 which engages the undersurface of the panel 132 when the bridge assembly 22 is pivoted to its open position.

Similarly, a pair of exit roller assemblies 154 are mounted to the panel 132 adjacent the trailing aperture 138. Each exit roller assembly 154 extends through a rectangular aperture in the associated ski in a manner similar to that employed in the bridge disclosed in FIGS. 3 and 4.

An abutment stop link 156 engages a bracket carrying the exit roller to limit the pivotal movement of the roller under the influence of a torsion spring when the bridge 22 is in its open position. In the closed or operative position, both the pick-up rollers and the exit rollers are downwardly biased against the enclosures tranvelling through the transport pathway.

An enclosure count switch 158 is mounted to the undersurface of the chassis panel 132 and is actuated to detect the entry of each enclosure into the pick-up station of the inserter 10. To actuate the switch 158, a wiper arm 160 (FIG. 7) is pivotally mounted to a pin projecting from a bracket 162 adjacent one of the exit roller assemblies 154. The wiper arm 160 is urged toward a position wherein it extends into the enclosure pathway by a spring 164. The spring 164 is secured at one end to a pin 166 which projects from a radial dog of the wiper arm 160. The pin 166 additionally engages a switch actuator rod 168. A tab projecting laterally from the end of the wiper rod 160 contacts the switch 158.

The actuator rod 168 additionally includes a slot through which a post extending from the bracket 162 and supporting the opposite end of the spring 164 projects.

Figure 2:
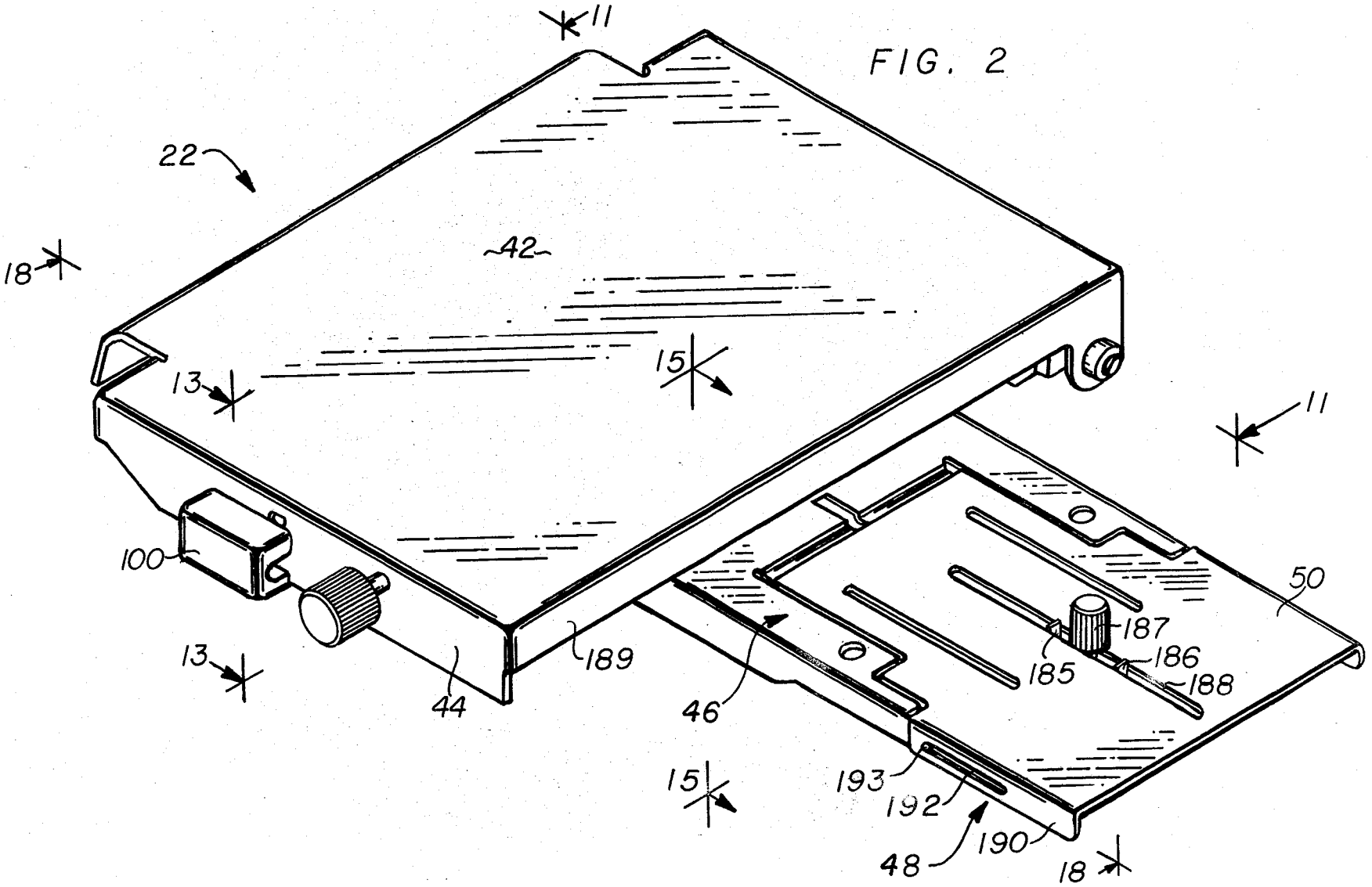
FIG. 2 is a perspective illustration of the articulate bridge assembly with the remainder of the inserter omitted and showing a cover and a chassis secured to the underside of the cover and projecting outwardly therefrom.
Figure 8:
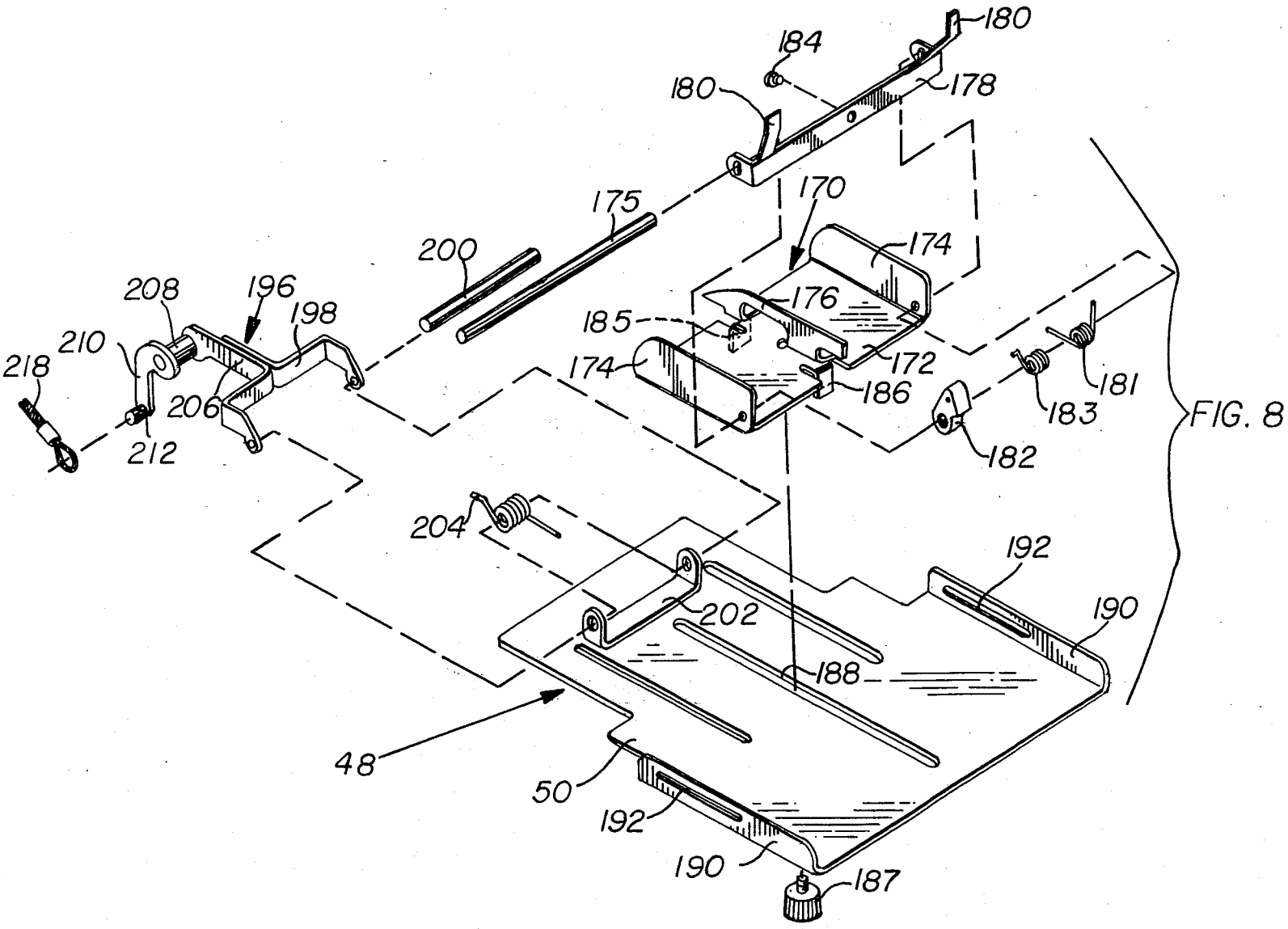
FIG. 8 is an exploded perspective view of an enclosure gate and pivotal offset link which joins the gate to the chassis, also in an inverted position and with portions deleted.
Figure 10:
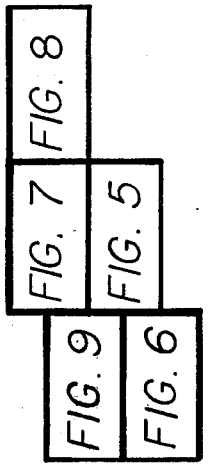
FIG. 10 is a map which indicates the interrelationship between the exploded bridge components illustrated in FIGS. 5 through 9.

Referring now to FIGS. 2 and 8, the enclosure pick-up gate 48 includes an upper door 50 configured so as to sit within the aperture 138 of the chassis 46. The gate 48 includes a bracket assembly 170 having a planar base 172 and a pair of opposed downwardly directed side walls 174. A central flange 176 projects downwardly from the base 176 between and parallel to the side walls 174. The peripheries of the side walls and of the flange provide a smooth, gradually tapered surface for guiding the forwardly advancing enclosures.

Adjacent the rear ends of the side walls 174, registered apertures are provided for a pin 175 through which an enclosure stop 178 is pivotally mounted. The enclosure stop 178 includes an elongate base or bar having perpendicular ears at opposite ends through which the pin 175 extends. A pair of stop fingers 180 project forwardly and downwardly from the base (FIG. 18) into the pick-up station and provide an abutment stop for enclosures advancing along the transport pathway. A torsion spring 181 mounted concentrically about the gate hinge pin 175 biases the enclosure stop 178 into such position which is maintained by engagement between a bumper 184 and the flange 176.

The hinge pin 175 additionally includes a pawl 182 having a notched surface which engages the base of the enclosure stop 178. The pawl 182 is urged against the stop 178 by a spring 183. The pawl projects into the pick-up station to a depth less than that of the finger stops 180 but sufficient to be engaged by the blade of a ram mechanism which is employed to transport enclosures from the pick-up station into waiting envelopes. The ram blade rides over the top of the enclosures as fully disclosed in U.S. Pat. No. 2,914,895. The forward motion of the ram blade permits the enclosure stop 178 to pivot forwardly against the bias of the spring 181 and release the enclosure.

A pair of tabs 185, 186 project upwardly from the base 172 into a slot 188 formed in the door 50. Thus, the base 172 and the stop 178 are slidable relative to the door 50. An adjustable position is fixed by a hand tightened screw knob 187.

To adjust the stop 178 for enclosures of different widths, the bridge assembly 22 is placed in operative position (shown in FIG. 2) and the knob 187 loosened. The operator then positions an enclosure over the chassis 46 between a side wall 189 of the cover 42 and the tab 185. The knob 187 is then moved longitudinally along the slot until the tab 185 abuts the leading edge of the enclosure with the enclosure trailing edge abutted against the side wall 189.

The distance between the side wall 189 and the tab 185 is the same as the distance between the trailing end of the pick-up station (fixed with respect to the frame 56) and the stop fingers 180. It will be appreciated that this dimensional equality does not vary due to the integrity of the vertical plane of the bridge assembly relative to the frame as maintained by the cover hinge.

The door 50 includes downturned side walls 190 having an elongate longitudinal slot 192. Each slot 192 is engaged by a pin 193 (see FIG. 7) which extends through a pair of apertures 194 formed in the side walls of the chassis 46 adjacent its trailing end. The engagement of the pins 193 in the slots 192 facilitates a sliding articulated motion for retraction of the gate 48 from a horizontal operative position partially beneath an envelope flapper to an accessible position when the bridge assembly 22 is pivoted open. Additionally, the engagement between the pins 193 and the trailing ends of the slots 192 provide limit stops for such motion relative to the chassis 46 and the cover 42.

The articulated motion is achieved through a pivotal offset link 196 which includes a yoke 198 at one end. The link 196 is hinged to the underside of the door 50 through a pin 200 which extends through apertures in the yoke 198 and mating apertures in a bracket 202 projecting from the door 50. A torsion spring 204 biases the door 50 to a horizontal operative position relative to the link 196 (FIG. 8).

The offset link 196 includes a beam 206 which extends perpendicular to the bight of the yoke 198 and is fixed to a a perpendicularly extending sleeve 208. A pawl 210 is fixed to the opposite end of the sleeve 208. From the sleeve, the pawl 210 extends in a direction parallel to the beam 206 and then an arm projects perpendicularly upward. A pin 212 projects laterally from the end of the pawl arm.

A common bore extends through the sleeve 208, the pawl 210 and the beam 206. The pivotal offset link 196 is hinged for rotation relative to the chassis 46 at a bracket 214 (see FIGS. 7 and 16). Adjacent the bracket 214, the panel 132 of the chassis 46 includes a rectangular aperture 216 and the perpendicular arm of the pawl 210 projects upwardly through the aperture 216.

Figures 17, 18:
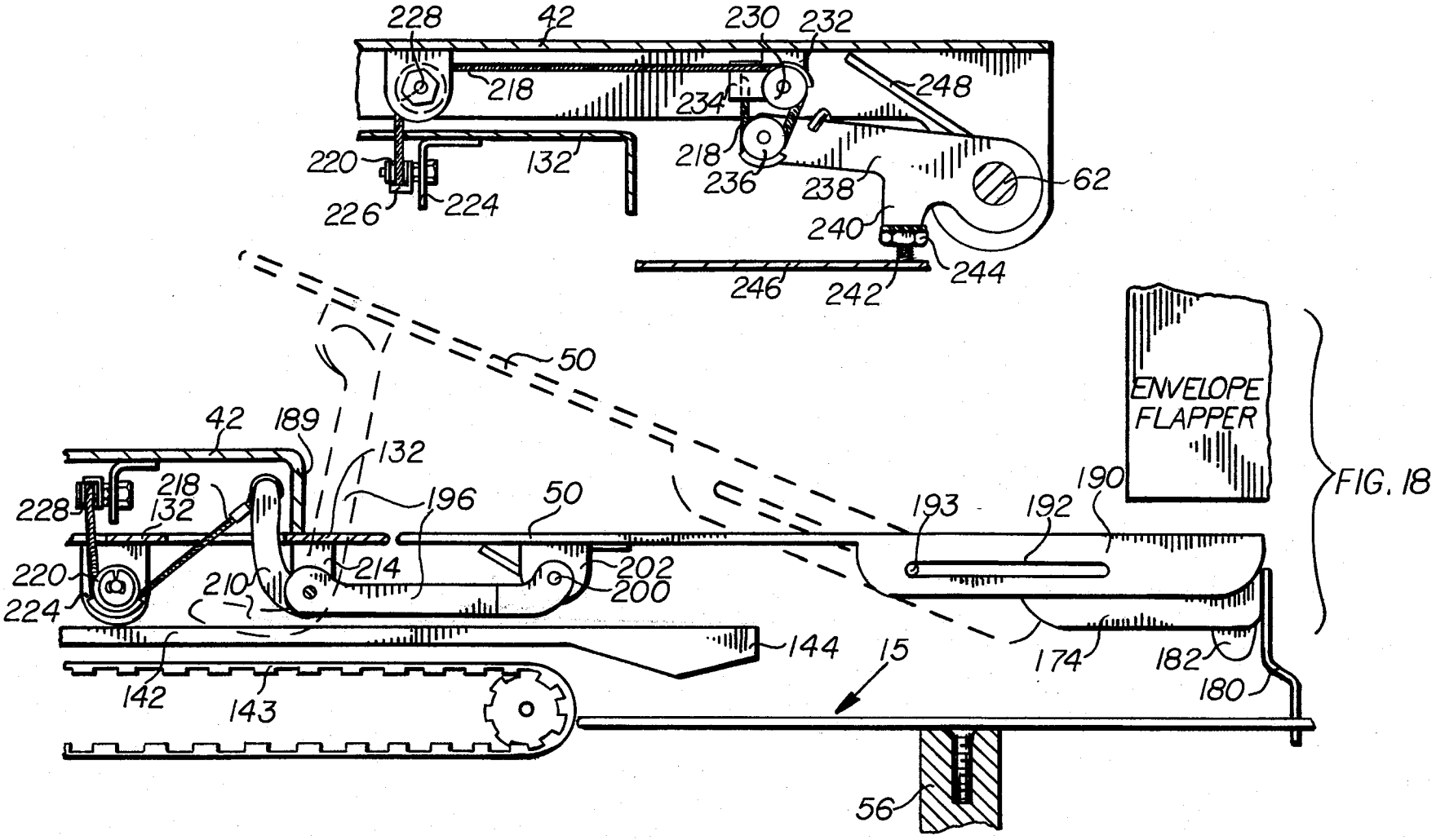
FIG. 17 is an enlarged scale fragmentary sectional view through the cover and the chassis, the same being taken substantially along the plane 17—17 of FIG. 16 and showing further details of the wire rope path.
FIG. 18 is an enlarged fragmentary sectional view through the bridge assembly and portions of the inserter under the bridge assembly, the same being taken substantially along the plane 18—18 of FIG. 2, however with the plane 18—18 distorted to view a side wall of the gate assembly in elevation.

A wire rope cable 218 engages the pin 212 and causes the pivotal offset link 196 to rotate in a counterclockwise direction as viewed from FIG. 18 about a pin in the bracket 114 simultaneously with the pivoting of the bridge cover 42 about its hinge mechanism to an open position. Such movement results when the pawl arm is pulled downward by the wire rope 218. The yoke 198 and a portion of the beam 206 project upwardly and above the elevation of the cover 42. At the same time, the door 50 is drawn forwardly toward the direction of the pick-up roller and with the pins 193 engaging the slots 192 and providing a limit stop when the ends of the slots are reached.

The wire rope 218 extends from the pawl pin 212 downwardly through the chassis aperture 216 to a first pulley 220 journalled about a post 222 which is secured to a bracket 224 projecting downwardly from the undersurface of the chassis panel 132. Additionally mounted to the post 222 is a retaining shield 226 which prevents disengagement of the wire rope (see FIGS. 7, 16 and 17).

The rope thereafter extends upwardly through the intermediate aperture 136 formed in the panel 132 to a second pulley 228 (see FIGS. 5 and 17) mounted to the undersurface of the cover 42 through a post, bracket and shield in a manner identical to the pulley previously described. From the second pulley 228, the wire rope 218 extends horizontally to a third pulley 230 which is mounted to a bracket 232 projecting downwardly from the cover 42 adjacent one of the hubs 68 (see FIGS. 5 and 17). The pulley 230 is mounted in a manner identical to that of the prior pulleys, however the bracket 232 is modified and includes a laterally projecting flange 234.

Figure 16:
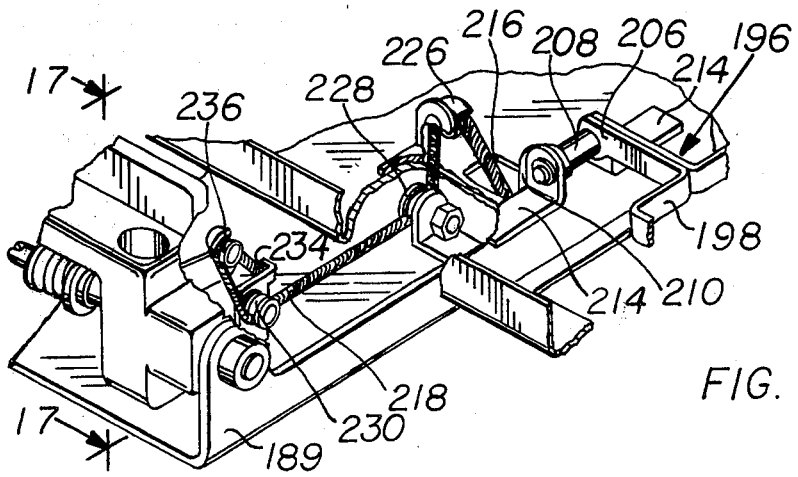
FIG. 16 is a fragmentary perspective illustration of a portion of the cover and chassis with portions cut away to illustrate the path of a wire rope employed for actuating the offset link.
Figure 14:
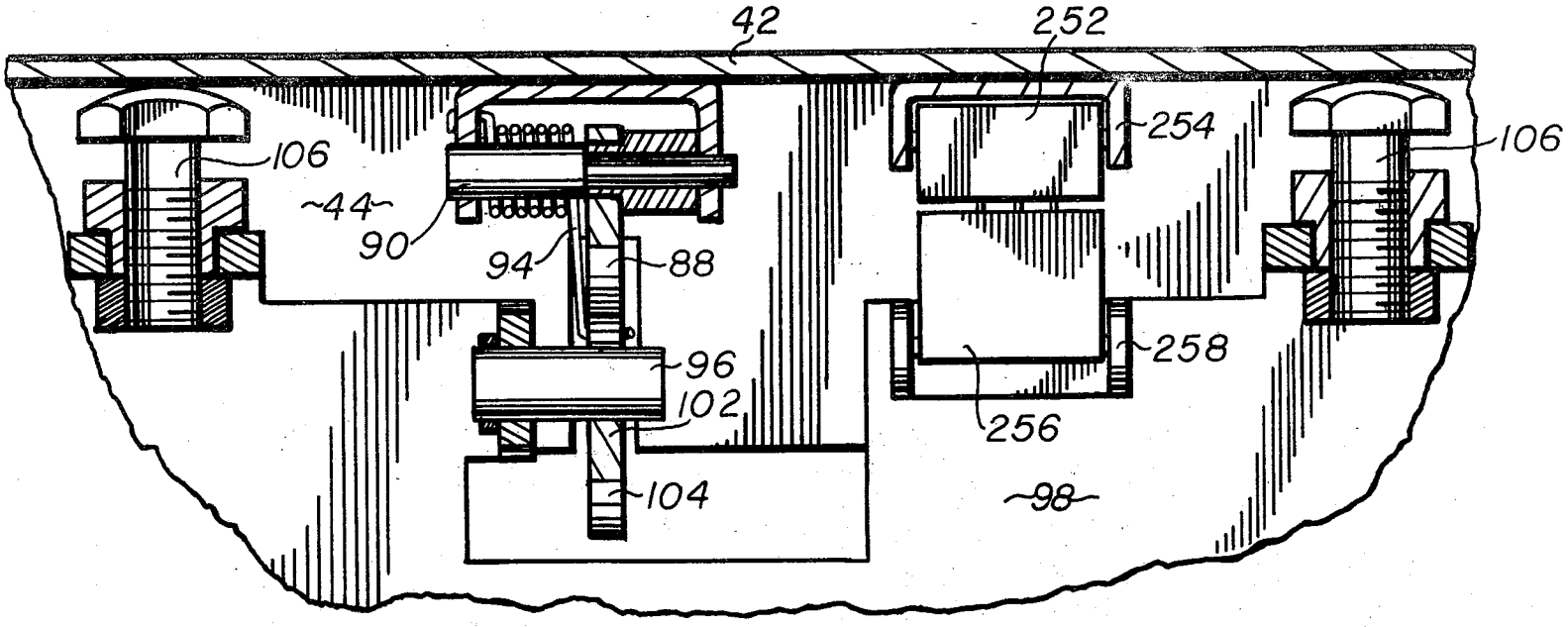
FIG. 14 is a sectional view through the cover latch, the same being taken substantially along the plane 14—14 of FIG. 13.

Referring now to FIGS. 16 and 17, the rope extends from the third pulley 230 downwardly and forwardly to a fourth pulley 236 mounted to a take up arm 238. The fourth pulley 236 is mounted to the arm 238 through a post and shield in a manner identical to that described with reference to the previous pulleys. As best viewed in FIG. 17, the wire rope 218 loops around the fourth pulley 236 and thereafter is anchored to the flange 234 of the third pulley bracket 232.

The take up arm 238 includes a hub journalled on the hinge pin 62. A tangential branch 240 projecting downwardly from the arm 238 includes a lateral extension having a threaded aperture which receives a matingly threaded adjustment shaft 242. To secure the shaft 242 in its adjusted position, a lock nut 244 bears against the undersurface of the lateral extension.

As shown in FIG. 17, the tip of the adjustment shaft 242 engages a deck surface 246 of the inserter when the bridge assembly 22 is in its operative position. The deck surface 246 is fixed relative to the inserter frame 56. The take up arm 238 is maintained in the position shown in FIG. 17 when the bridge assembly is in its operative position with the cover 42 closed due to a torsion spring 248 which is coiled about the hinge pin 62. One arm of the spring 248 bears against the undersurface of the cover 42 while the other arm bears downwardly against the take up arm 238.

It should be appreciated that when the bridge assembly 22 is in its operative position with the cover 42 latched as shown in FIG. 2, the wire rope 218 will be slack. The door 50 will be maintained in its horizontal position due to the torsion spring 204; the take up arm 238 will be in the position shown in FIG. 17 due to the torsion spring 248.

A portion of the stop gate 48 will underlie an envelope flapper unit of the inserter as illustrated in FIG. 18. To access the transport pathway and the pick-up station 15, the latch release knob 100 is lifted and the cover 42 pivoted upwardly about its hinge. During the initial rotation of the cover 42, the take up arm 238 will be maintained in the position shown in FIG. 17 due to the downward bias of the spring 248. Thus, the third pulley 230 will move in an upward arcuate path (clockwise as viewed in FIG. 17) away from the fourth pulley 236. This results in a reduction of the slack in the wire rope 218 and causes the offset link 196 to pivot about the pin in the bracket 214 to the position shown in dashed lines in FIG. 18. Such final position is assumed when the pins 193 at the end of the chassis 46 engage the ends of the slots 192 of the door side walls 190. The door 50 is canted upwardly beyond the cover 42 at one end and downwardly at the other and has ducked beneath and retracted from the envelope flapper unit.

Once the offset link has assumed the dashed line position of FIG. 18, the maximum distance between the pulley 230 and the pulley 236 has been attained and the taught wire rope 218 will prevent further relative movement. At this juncture (approximately the initial 20 degrees of rotation of the cover 42) the take up arm 238 will now pivot unitarily with the cover 42 and the chassis 46 for the duration of the pivotal movement with the entire bridge assembly 22.

Upon closing the bridge assembly by pivoting the cover 42 in a reverse direction, the bridge assembly 22 will move as an entire unit until the tip of the adjustment shaft 242 contacts the deck surface 246 whereupon the wire rope will begin to slacken until the cover has been latched. The door 50 will be urged to its operative position, with the envelope flapper overlying a portion thereof, due to the bias of the spring 204 at the bracket 202.

A further feature of the bridge assembly resides in an electrical interconnection between an inserter control circuit and the electrical switches 30, 158 carried by the cover 42. In accordance with the invention, the bridge assembly 22 is physically, as well as electrically, disconnected from the control circuit when the cover is opened through a safety interlock.

Referring again to FIG. 14, a male multiple prong electrical connector 252 is adjustably mounted to the underside of the cover 42 adjacent and behind the front panel 44 through a carrier bracket 254. A mating female connector 256 is similarly mounted to the rigid bracket 98 through a carrier bracket 258. Electrical leads extend from the switches 30, 158 to the male connector 252 while similar electrical leads extend from the female connector 256 to the control circuit.

In the event the control circuit does not automatically shut down the power supply to the switches 30, 158 upon sensing that the cover 42 has been opened, the operator cannot be injured since there are no exposed electrical elements and all electrical leads to the bridge assembly 22 are physically disconnected.

Thus, it will be seen that there is provided an articulate bridge assembly which achieves the various objects of the invention and which is well suited to meet the conditions of practical use.

As various changes might be made in the invention as above set forth, it is to be understood that all matter herein described or shown in the accompanying drawings is to be interpreted as illustrative and not in a limiting sense.

Having thus described the invention, there is claimed as new and desired to be secured by Letters Patent:

1. In an articulate bridge assembly adapted to overlie an enclosure transport pathway of an envelope inserter having a frame, wherein the bridge assembly comprises a carriage, the carriage including biasing means for engaging the upper surface of successive enclosures traversing the pathway, the bridge assembly including hinge means interconnecting the bridge assembly and the frame, the hinge means extending along an axis parallel to the direction of enclosure transport and the hinge means including means for counterbalancing the weight of the bridge, whereby the bridge assembly may be pivoted about the hinge means from an operative position to open the enclosure transport pathway for servicing and adjustment, an improvement in the counterbalancing means, said improvement comprising:

(a) a pair of cams in mutual engagement, (b) means fixing one of the cams for rotation unitarily with the bridge assembly, (c) means fixing the other cam against rotation, and (d) resilient means biasing the cams against one another.

2. An articulate bridge assembly adapted to overlie an enclosure transport pathway of an envelope inserter having a frame, the bridge assembly comprising a carriage, the carriage including biasing means for engaging the upper surface of successive enclosures traversing the pathway, the bridge assembly further including switch means for detecting the presence of multiple enclosures in the pathway and hinge means interconnecting the bridge assembly and the frame, the hinge means extending along an axis parallel to the direction of enclosure transport, whereby the bridge assembly may be pivoted about the hinge means from an operative position to open the enclosure transport pathway for servicing and adjustment, the hinge means including means for counterbalancing the weight of the bridge, and the counterbalancing means comprising:

(a) a pair of cams in mutual engagement, (b) means fixing one of the cams for rotation unitarily with the bridge assembly, (c) means fixing the other cam against rotation, and (d) resilient means biasing the cams against one another.

3. An articulate bridge assembly constructed in accordance with claim 2, wherein the enclosure transport pathway includes an enclosure pick-up station, the bridge assembly further including an enclosure stop gate, and the stop gate being positioned in registry with the pick-up station.

4. An articulate bridge assembly constructed in accordance with claim 2 wherein the hinge means includes a hinge pin, means fixing the hinge pin relative to the bridge assembly, the one cam being fixed to the hinge pin, and means journalling the hinge pin within the other cam.

5. An articulate bridge assembly constructed in accordance with claim 1 wherein the bridge assembly is located in a predetermined horizontal reference plane when disposed in the operative position thereof, and the hinge means including means biasing the bridge assembly for location in the horizontal reference plane.

6. An articulate bridge assembly constructed in accordance with claim 5 wherein the hinge means includes a hinge pin and means fixing the hinge pin with respect to the bridge assembly, hinge support means fixed to the frame, means journalling the hinge pin in the support means, the biasing means including resilient means engaging the hinge pin and exerting a downward vertical force thereto.

7. An articulate bridge assembly constructed in accordance with claim 1 wherein the bridge assembly is located in a predetermined vertical reference position, and the bridge assembly including resilient means biasing the bridge assembly for location in the vertical reference position.

8. An articulate bridge assembly constructed in accordance with claim 7 wherein the hinge means includes a hinge pin, means fixing the hinge pin with respect to the bridge assembly, support means fixed to the frame, means journalling the hinge pin in the support means, the biasing means including means engaging the hinge pin and exerting an axial force thereto.

* * * * *